US009896747B2

(12) United States Patent
Kang

(10) Patent No.: US 9,896,747 B2
(45) Date of Patent: Feb. 20, 2018

(54) ALUMINUM ALLOY WITH LOW DENSITY AND HIGH HEAT RESISTANCE

(71) Applicant: Hyundai Motor Company, Seoul (KR)

(72) Inventor: Hee-Sam Kang, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/494,963

(22) Filed: Sep. 24, 2014

(65) Prior Publication Data

US 2015/0144227 A1 May 28, 2015

(30) Foreign Application Priority Data

Nov. 27, 2013 (KR) ..... 10-2013-145599

(51) Int. Cl.
*C22C 21/08* (2006.01)
*C22F 1/047* (2006.01)
*F02F 3/00* (2006.01)

(52) U.S. Cl.
CPC ..... *C22C 21/08* (2013.01); *C22F 1/047* (2013.01); *F02F 3/0084* (2013.01); *F05C 2201/021* (2013.01); *F05C 2201/028* (2013.01); *F05C 2201/0475* (2013.01); *F05C 2201/0487* (2013.01); *F05C 2201/903* (2013.01); *F05C 2203/06* (2013.01)

(58) Field of Classification Search
CPC ..... C22C 21/08; C22C 21/06
See application file for complete search history.

(56) References Cited

U.S. PATENT DOCUMENTS

2012/0034128 A1 2/2012 Yamaura et al.
2014/0290437 A1* 10/2014 Pabel ..... C22C 1/026 75/392

FOREIGN PATENT DOCUMENTS

| | | | | |
|---|---|---|---|---|
| GB | 2500825 A | * | 10/2013 | ..... C22C 1/026 |
| JP | 1-132737 | | 5/1989 | |
| JP | 07-197170 A | | 8/1995 | |
| JP | 2000-204428 A | | 7/2000 | |
| JP | 2003-096531 A | | 4/2003 | |
| KR | 81-001116 B1 | | 9/1981 | |
| WO | WO 2011090451 A1 | * | 7/2011 | ..... C22C 21/08 |
| WO | WO 2012149589 A1 | * | 11/2012 | ..... C22C 1/026 |

* cited by examiner

*Primary Examiner* — Roy King
*Assistant Examiner* — Janelle Morillo
(74) *Attorney, Agent, or Firm* — Mintz Levin Cohn Ferris Glovsky and Popeo, P.C.; Peter F. Corless

(57) ABSTRACT

The present invention relates to an aluminum alloy having low density and enhanced heat resistance. An aluminum alloy having improved high temperature physical properties comprises: magnesium (Mg) in an amount of about 7 to about 11 wt %, silicon (Si) in an amount of about 4 to about 8 wt %, copper (Cu) in an amount of about 0.5 to about 2 wt % and manganese (Mn) in an amount of about 0.3 to about 0.7 wt %, and a balance of aluminum based on the total weight of the aluminum alloy. Vehicle parts such as a piston, a housing and/or a bed plate of high power engine, to which the aluminum alloy may be applied, are provided as well.

4 Claims, 2 Drawing Sheets

ALUMINUM ALLOY WITH LOW DENSITY AND HIGH HEAT RESISTANCE

CROSS-REFERENCE TO RELATED APPLICATION

The present application claims priority to Korean Patent Application No. 10-2013-145599, filed on Nov. 27, 2013, the entire contents of which is incorporated herein for all purposes by this reference.

TECHNICAL FIELD

The present invention relates to an aluminum alloy composition having low density and enhanced heat resistance. In particular, the aluminum alloy of the present invention may provide light-weighted and improved-high temperature physical properties by adjusting composition ratio of the aluminum alloy. In addition, a piston, a housing, a bed plate of a high power engine and the like of a vehicle comprising the aluminum alloy are provided.

BACKGROUND

Recently, various environmental regulations have been strengthened due to climate changes, depletion of petroleum resources, and increase of greenhouse gases. Accordingly, countries including advanced countries have been making efforts to prevent environment pollution and vehicle industries have been made extensive researches to improve fuel efficiency and high powering of an engine.

In this respect, the present invention relates to an aluminum alloy that may be light-weighted and have improved-high heat resistance, thereby providing the aluminum alloy which may be applicable to a high power engine of a vehicle. In general, aluminum (Al) has been widely used in various industries since aluminum may be casted easily, alloyed well with other metals, and processed at room temperature and high temperature, and may have strong corrosion resistance to atmosphere and improved electrical and heat conductivity.

Particularly, since aluminum may have significantly low specific gravity among other metals, it has been used increasingly. But, since aluminum itself may have lower strength than other metals, aluminum alloys have been made progressively in order to compensate fragility of aluminum.

In current vehicle industry, a piston applied to an engine of a vehicle has been made of aluminum alloys; generally aluminum-silicon-copper-nickel (Al—Si—Cu—Ni) series alloys, or particularly Al-12Si-4Cu-3Ni series alloys has been used. However, the limit of material heat resistance of such aluminum alloys may be of about 110 bar level, which does not meet the material heat resistance limit to be applied to high powering engine in the future, for instance, up to about 130 bar.

Additionally, as the demands of reducing weight of various parts of vehicles has continuously increased, researches in novel alloys such as magnesium (Mg) alloys as an alternative material of aluminum alloys have been conducted. However, the application of magnesium has been reported to have limitations due to its high cost and low corrosion resistance.

The description provided above as a related art of the present invention is just for helping understanding the background of the present invention and should not be construed as being included in the related art known by those skilled in the art.

SUMMARY OF THE INVENTION

The present invention may provide a technical solution to above-described problems of the related art. The present invention provide an aluminum alloys of aluminum-magnesium-silicon-copper-manganese (Al—Mg—Si—Cu—Mn) series which may have high heat resistance and low density comparing to aluminum alloys of Al—Si—Cu—Ni series, thereby being applied to a vehicle part, such as an engine piston.

In an exemplary embodiment, an aluminum alloy having enhanced heat resistance and low density may comprise magnesium (Mg) in an amount of about 7 to about 11 wt %, silicon (Si) in an amount of about 4 to about 8 wt %, copper (Cu) in an amount of about 0.5 to about 2.0 wt % and manganese (Mn) in an amount of about 0.3 to about 0.7 wt %, and a balance of aluminum. It is understood that weight percents (wt %) of alloy components as disclosed herein are based on total weight of the aluminum alloy, unless otherwise indicated.

The present invention also provides the aluminum alloys that consist essentially of, or consist of, the disclosed materials. In an exemplary embodiment, an aluminum alloy is provided that consists essentially of, or consists of: magnesium (Mg) in an amount of 7 to 11 wt %, silicon (Si) in an amount of 4 to 8 wt %, copper (Cu) in an amount of 0.5 to 2.0 wt % and manganese (Mn) in an amount of 0.3 to 0.7 wt %, and a balance of aluminum.

In particular, magnesium silicide ($Mg_2Si$) formed as of a primary crystal in the aluminum alloys may be refinery-treated. In addition, and the aluminum alloy may be processed with heat treatment after die casting. The heat treatment may include, without limitation, artificial age-hardening after cooling at a high temperature processing or by stabilizing after solution heat treatment.

Further provided are vehicles and vehicle parts that comprise one or more of the aluminum alloys disclosed herein. In an exemplary embodiment, the aluminum alloy may be applied to a vehicle part, or particularly to an engine piston.

Other aspects of the invention are disclosed infra.

BRIEF DESCRIPTION OF THE DRAWINGS

The above and other features of the present invention will now be described in detail with reference to exemplary embodiments thereof illustrated the accompanying drawings which are given hereinbelow by way of illustration only, and thus do not limit the scope of the present invention, and wherein.

DETAILED DESCRIPTION

Figure 1:
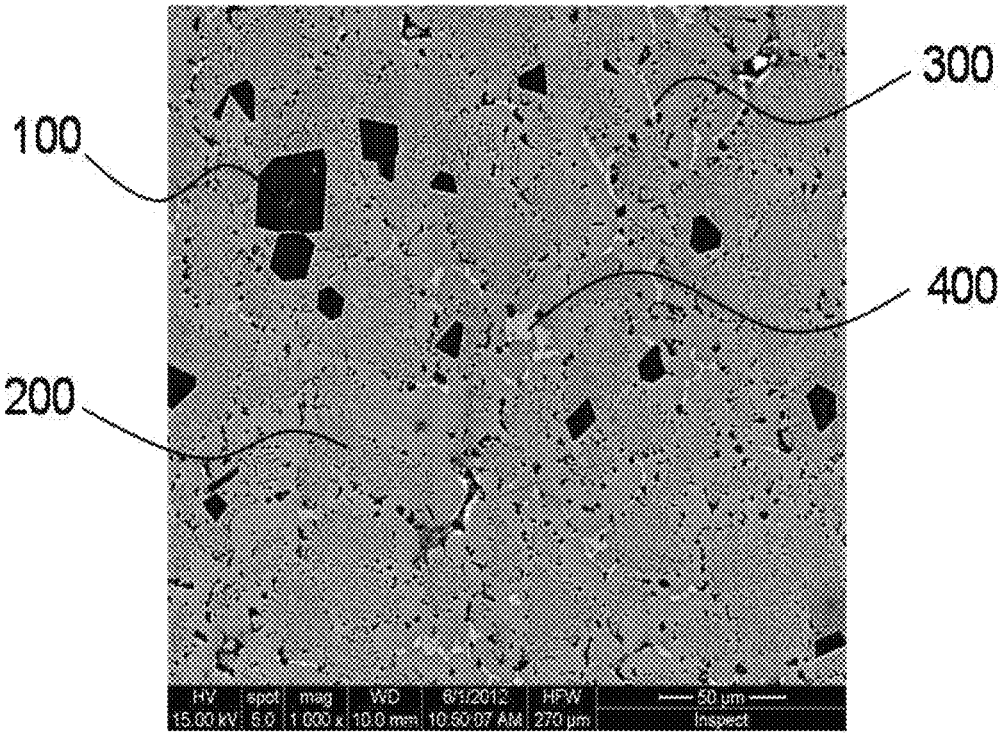
FIG. 1 is a microscopic view showing an exemplary internal fine structure of an exemplary aluminum alloy composition according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogenpowered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

The terms and the words used in the specification and claims should not be construed with common or dictionary meanings, but construed as meanings and conception coinciding the spirit of the invention based on a principle that the inventors can appropriately define the concept of the terms to explain the invention in the optimum method. Therefore, embodiments described in the specification and the configurations shown in the drawings are not more than the most exemplary embodiments of the present invention and do not fully cover the spirit of the present invention. Accordingly, it should be understood that there may be various equivalents and modifications that can replace those when this application is filed.

In one aspect, the present invention relates to an aluminum alloy which may have low density and enhanced heat resistance. In particular, the present invention relates to the aluminum alloys of Al—Mg—Si—Cu—Mn series which may have enhanced heat resistance and low density. In another aspect, the aluminum (Al) alloys may be used in manufacturing of an engine piston of a vehicle by conventional process, without limitation, such gravity casting, heat treatment and the like.

In addition, the present invention provides an aluminum alloy having low density, which may have improved high temperature physical properties such as tensile strength and weight reducing effect. Therefore, severe operating conditions, such as increase of the load applied to a piston in accordance with the increase of engine power, and the like, may be compensated by using the aluminum alloy composition of the present invention.

In an exemplary embodiment, the aluminum (Al) alloys of the present invention may comprise magnesium (Mg) in an amount of about 7 to about 11 wt %, silicon (Si) in an amount of about 4 to about 8 wt %, copper (Cu) in an amount of about 0.5 to about 2 wt % and manganese (Mn) in an amount of about 0.3 to about 0.7 wt %, and a balance of aluminum, based on the total weight of the aluminum alloy.

As used herein, a term "intermetallic compound" refers to a compound made by combining two or more metallic elements in a simple integer ratio. Unlike a solid solution of a common alloy, physical and chemical properties of the intermetallic compound may differ clearly in its components. For example, the intermetallic compound may be, but not limited to, $Mg_2Si$ series, AlMg series, AlMn series or AlCuMg series.

Magnesium (Mg) may be an element for forming the intermetallic compounds of $Mg_2Si$ series and AlMg series, which may contribute to enhancing heat resistance at high temperature while lowering the density of an alloy. In particular, an amount of about 7 to about 11 wt % of Mg may be included in total weight of the aluminum alloy. When the contents of Mg in the total weight of alloy is less than about 7 wt %, the reducing of the alloy and the mechanical properties of alloy may be insufficient; when the contents of Mg in the total weight of alloy is greater than about 11 wt %, the alloy may be difficult to be dissolved under atmospheric condition since the alloy becomes greatly oxidative, and productivity of the gravity casting process may be deteriorated. Accordingly, the content of Mg may be in a range of about 7 to about 11 wt % of Mg.

For instance, when the aluminum alloy includes up to about 10 wt % of magnesium (Mg) in total weight of alloys, the density of the aluminum alloy is about 2.59 g/cm$^3$, which is smaller than the density of conventional aluminum alloy, i.e. 2.75 g/cm$^3$, thereby achieving the weight reducing through low density.

TABLE 1

| Magnesium (Mg) by Weight | Specific Gravity |
|---|---|
| 5 wt % | 2.66 (2.9% fi) |
| 10 wt % | 2.59 (5.8% fi) |
| 15 wt % | 2.52 (8.7% fi) |
| 20 wt % | 2.45 (10.9% ic) |

Table 1 shows specific gravities of exemplary aluminum alloys according to the content of magnesium (Mg). As shown in Table 1, specific gravities of total aluminum (Al) alloys may decrease gradually as the content of magnesium increases. When magnesium is included in the above range, i.e. greater than about 10 wt %, the weight of the alloy may be reduced by about 5.8% of total weight in comparison to the weight of conventional aluminum (Al) alloys.

Silicon (Si) may be an element for forming the intermetallic compound of $Mg_2Si$ series by reacting with the magnesium (Mg). In particular, an amount of about 4 to about 8 wt % of Si may be included in total weight of the aluminum alloys. When the content of Si is less than about 4 wt %, the formation of excess AlMg intermetallic compound may deteriorate castability of alloy; when the content of Si is greater than about 8 wt %, the $Mg_2Si$ particles of the primary crystal may become coarse and clustered thereby deteriorating heat resistance and mechanical properties. Accordingly, the content of Si in the alloy may be in a range of about 4 to about 8 wt %.

Manganese (Mn) may be an element for preventing seizure of molten alloy to die. Particularly, an amount of about 0.3 to about 0.7 wt % of Mn may be included in total weight of alloys. When the content of Mn is less than about 0.3 wt %, the effect of preventing seizure of molten alloy to die may be insufficient; when the contents thereof is greater than about 0.7 wt %, the castability of alloy may be worse. Accordingly, the content of Mn in the aluminum alloy may be in a range of about 0.3 to about 0.7 wt %.

Copper (Cu) may be an element for forming the intermetallic compound of AlCuMg series by reacting with magnesium (Mg) and aluminum (Al). Particularly, an amount of about 0.5 to about 2 wt % of Cu may be included in total weight of alloys. When the content of Cu is less than about 0.5 wt %, the physical properties such as heat resistance at high temperature may not be improved sufficiently since the intermetallic compounds are not produced; when the content of Cu is greater than about 2 wt %, the intermetallic compound may be coarse and the castability of alloy may also be worse. Accordingly, the content of Cu in the aluminum alloy may be in a range of about 0.5 to about 2 wt %.

Figure 2:
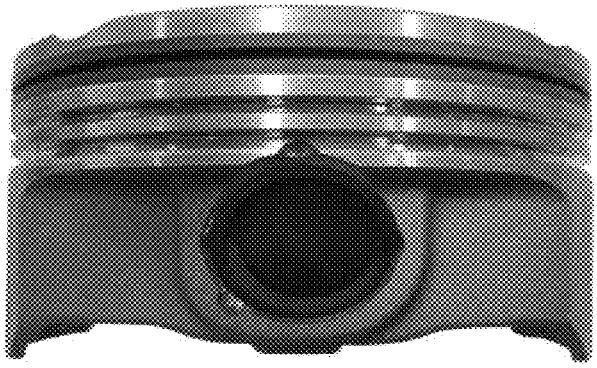
FIG. 2 is a photographic view of an exemplary piston to which an exemplary aluminum alloy composition according to another exemplary embodiment of the present invention may be applied.

FIG. 1 is a microscopic view showing an exemplary internal fine structure of an exemplary aluminum alloy having the composition according to an exemplary embodiment of the present invention, and FIG. 2 is a photographic view of an exemplary piston to which an exemplary aluminum alloy may be applied according to another exemplary embodiment of the present invention is applied.

As shown in FIG. 1, primary crystals of $Mg_2Si$ (100) may be produced at a size in a range of about 2 to about 30 μm. In addition, eutectic $Mg_2Si$ (200) of fibrous phase, and various types of intermetallic compounds such as AlCuMg series (300) and AlMn series (400) and the like may be formed in the aluminum alloy.

The alloy having the composition according to an exemplary embodiment of the present invention may achieve weight reducing effect due to its low density through the addition of magnesium (Mg) and may improve physical properties at high temperature through the production of various types of intermetallic compounds.

TABLE 2

| Type | Method |
|---|---|
| T1 | Naturally aging heat-treated after cooling at a high temperature processing |
| T2 | Processed and aging heat-treated naturally again after cooling at a high temperature process |
| T3 | Cold processed and aging heat-treated naturally again after solution heat treatment |
| T4 | Naturally aging heat-treated after solution heat treatment |
| T5 | Artificially age hardened after cooling at a high temperature processing |
| T6 | Artificially age hardened after solution heat treatment |
| T7 | Stabilized after solution heat treatment |
| T8 | Cold processed and artificially age hardened again after solution heat treatment |
| T9 | Artificially age hardened again and cold processed again after solution heat treatment |
| T10 | Cold processed artificially age hardened again after cooling at a high temperature processing |

In Table 2, various exemplary methods of a general heat treatment process for aluminum alloys are listed. In particular, the aluminum alloys may be used in manufacturing of a high power engine piston, and the like, by T5 or T7 heat treatment process after refinery treatment (AlP treatment) to $Mg_2Si$ of the primary crystal and gravity casting or strand casting thereof. During T5 or T7 process, the AlP treatment may be performed by adding phosphorus (P) as of a refinery agent into molten metal to refine Si and the like, of the primary crystal. Since phosphorus added to molten metal may produce AlP, and the like in reaction with aluminum (Al), the AlP and the like may serve as nucleus generation sites of Si of the primary crystal to refine $Mg_2Si$ and the like, of the primary crystal. When it is necessary to obtain sufficient refinery effect, treatment time for molten metal may be required for greater than a predetermined time at elevated temperature after adding the refinery agent.

Example 1

Hereinafter, the present invention will be further described in detail with reference to certain exemplary embodiments thereof illustrated the accompanying drawings which are given hereinbelow by way of illustration only, and thus are not limitative of the present invention.

TABLE 3

| | Example 1 | Comparative Example 1 |
|---|---|---|
| Bore Diameter | 84 mm | 84 mm |
| Applicable Material | Al—10Mg—4.8Si—0.6Mn—1.8Cu | Al—12Si—3.2Cu—2.1Ni |
| Material Density | 2.59 g/cm$^3$ | 2.78 g/cm$^3$ |
| Piston Weight | 301 g | 320 g |

In Table 3, an exemplary piston to which an exemplary aluminum alloy according to an exemplary embodiment of the present invention is applied and a piston made from a conventional aluminum alloy are compared.

The exemplary piston made from Example 1 was manufactured with aluminum as a base material through gravity casting and T5 heat treatment after performing AlP treatment to molten metal to which an aluminum alloy is added. The aluminum alloy in Example 1 includes magnesium (Mg) in an amount of about 10 wt %, silicon (Si) in an amount of about 4.8 wt %, copper (Cu) in an amount of about 1.8 wt %, and manganese (Mn) in an amount of about 0.6 wt % in the total weight of the aluminum alloys.

On the other hand, the piston according to the Comparative Example 1 was manufactured with aluminum as a base material through gravity casting and T5 heat treatment after refining primary Si crystals in molten metal to which an aluminum alloy is added. The aluminum alloy in Comparative Example 1 includes silicon (Si) in an amount of about 12.2 wt %, copper (Cu) in an amount of about 3.2 wt %, and nickel (Ni) in an amount of about 2.1 wt % in the total weight of the aluminum alloys.

In Table 3, the density of an exemplary piston to which an aluminum alloy of the present invention is applied is less than the density of a piston of made from the conventional aluminum, thereby reducing the weight of the aluminum alloy.

TABLE 4

| | | Example 1 | Comparative Example 1 |
|---|---|---|---|
| Tensile Strength at Room Temperature | | 270 MPa | 250 MPa |
| Fatigue Strength | Room Temperature | 115 MPa | 110 MPa |
| | 150° C. | 100 MPa | 86 MPa |
| | 250° C. | 65 MPa | 50 MPa |
| Single Product Durability (Hydraulic) | | 220 bar | 205 bar |

In Table 4, physical properties of exemplary pistons according to Example 1 and Comparative Example 1 of Table 2 are shown. The tensile strength at room temperature was about 270 MPa in Example 1, which was significantly greater than Comparative Example 1; the fatigue strengths of Example 1 and Comparative Example 1 were similar at room temperature; but the fatigue strength of Example 1 was improved by about 20 to about 30% as the temperature was elevated, and the durability of Example 1 was improved by about 10 likewise.

The aluminum alloys according to various exemplary embodiments of the present invention may include magnesium up to about 15 wt % in total weight of the alloys, which is greatly different from the conventional aluminum alloys applied to a piston, thereby reducing the weight by about 10% and improving fuel efficiency when the aluminum alloy may be applied to a piston.

In addition, the aluminum alloys according to various exemplary embodiments of the present invention may be applicable to a high-power engine with the improvement of tensile and fatigue intensity, and the like, at elevated temperature by intermetallic compound particles, which may be produced by major alloy element, such as Mg and Si.

The invention has been described in detail with reference to preferred embodiments thereof. However, it will be appreciated by those skilled in the art that changes or modifications may be made in these embodiments without departing from the principles and spirit of the invention, the scope of which is defined in the appended claims and their equivalents.

What is claimed is:

1. An aluminum alloy having elevated heat resistance and low density consisting of: magnesium (Mg) in an amount of 8 to 11 wt %, silicon (Si) in an amount of 6 to 8 wt %, copper (Cu) in an amount of 0.5 to 2.0 wt % and manganese (Mn) in an amount of 0.3 to 0.7 wt %, and a balance of aluminum.

2. The aluminum alloy of claim 1, wherein the aluminum alloy is applied to an engine piston.

3. An automotive vehicle part comprising the aluminum alloy of claim 1.

4. The automotive vehicle part of claim 3 wherein the vehicle part comprises an engine piston.

* * * * *